United States Patent [19]

Carlson

[11] 4,206,043

[45] Jun. 3, 1980

[54] CONVERSION OF MERCAPTANS CONTAINED IN A SOUR PETROLEUM DISTILLATE

[75] Inventor: David H. J. Carlson, Park Ridge, Ill.

[73] Assignee: UOP Inc., Des Plaines, Ill.

[21] Appl. No.: 958,303

[22] Filed: Nov. 6, 1978

[51] Int. Cl.[2] ..... C10G 27/00

[52] U.S. Cl. ..... 208/207; 252/431 N

[58] Field of Search ..... 208/207, 206, 189; 252/431 N

[56] References Cited

U.S. PATENT DOCUMENTS

| | | | |
|---|---|---|---|
| 2,651,595 | 9/1953 | Moulthrop | 208/207 |
| 3,108,948 | 10/1963 | Ring | 208/189 |
| 3,144,403 | 8/1964 | Jacob | 208/207 |
| 3,392,111 | 7/1968 | Napier et al. | 208/189 |
| 3,396,123 | 8/1968 | Urban | 208/207 |
| 4,113,604 | 9/1978 | Carlson | 208/206 |

*Primary Examiner*—George Crasanakis

*Attorney, Agent, or Firm*—James R. Hoatson, Jr.; Robert W. Welch; William H. Page, II

[57] ABSTRACT

A method of treating a sour petroleum distillate for the conversion of mercaptans contained therein is disclosed. The distillate is treated in contact with an oxidizing agent and a catalytic composite comprising a metal chelate mercaptan oxidation catalyst impregnated on a basic anion exchange resin.

12 Claims, No Drawings

CONVERSION OF MERCAPTANS CONTAINED IN A SOUR PETROLEUM DISTILLATE

This invention relates to a method of treating a sour petroleum distillate for the conversion of mercaptans contained therein. Processes for the treatment of sour petroleum distillates wherein the distillate is treated in contact with a catalyst in the presence of an oxidizing agent at alkaline reaction conditions have become well-known and widely-practiced in the petroleum refining industry. Said processes are typically designed to effect the oxidation of offensive mercaptans contained in a sour petroleum distillate with the formation of innocuous disulfides—a process commonly referred to as sweetening. Depending on the source of the petroleum from which the sour petroleum distillate was derived, the boiling range of the distillate itself, and the method of processing the petroleum to produce the distillate, the distillates will vary widely with respect to the concentration, molecular weight and complexity of the mercaptans contained therein. For example, in lighter mercaptan-containing petroleum distillates, such as straight run gasolines, the mercaptans are primarily lower alkyl mercaptans which are readily oxidized to disulfides. On the other hand, mercaptan-containing gasolines derived from fluid catalytic cracking (FCC) processes are frequently relatively high in olefin content and comprise mercaptans which are more difficult to convert to disulfides, for example, aromatic and higher molecular weight branched chain alkyl mercaptans.

It has now been discovered that mercaptans, and especially mercaptans found in an FCC gasoline, are advantageously converted to disulfides by treating the gasoline in contact with a novel catalytic composite in the presence of an oxidizing agent. Utilization of a catalytic composite of this invention will provide the operator of FCC units an alternate and useful method for treating the effluent from said units for the conversion of mercaptans common thereto and production of a doctor sweet product.

It is an object of this invention to present a novel method for the conversion of mercaptans contained in a sour petroleum distillate, especially mercaptans contained in a sour gasoline derived from a fluid catalytic cracking operation.

In one of its broad aspects, the present invention embodies a method of treating a sour petroleum distillate for the conversion of mercaptans contained therein which comprises contacting said distillate with an oxidizing agent and a catalytic composite comprising a metal chelate mercaptan oxidation catalyst impregnated on a basic anion exchange resin.

One of the more specific embodiments relates to a method which comprises contacting said distillate with air and a catalytic composite comprising a metal phthalocyanine impregnated on an amine anion exchange resin comprising a porous styrene-divinylbenzene cross-linked polymer matrix.

A still more specific embodiment concerns a method of treating a sour petroleum distillate for the conversion of mercaptans contained therein which comprises contacting said distillate with air and a catalytic composite comprising cobalt phthalocyanine monosulfonate impregnated on an amine anion exchange resin comprising a porous styrene-divinylbenzene cross-linked polymer and tertiary amine functional groups.

Other objects and embodiments of this invention will become apparent in the following more detailed specification.

The catalytic composite of this invention comprises a metal chelate mercaptan oxidation catalyst impregnated on a basic anion exchange resin. There are a variety of basic anion exchange resins suitable for use in accordance with the present invention. The basic anion exchange resins will typically comprise primary, secondary and/or tertiary amine functional groups. Those anion exchange resins comprising predominantly tertiary amine functional groups, for example, dimethylaminomethyl functional groups, are among the more effective anion exchange resins. Further, certain basic anion exchange resins comprising cross-linked mono-ethylenically unsaturated monomer-polyvinylidiene monomer copolymer matrices have desirable surface area and high pore diameter properties affording greater access to a larger number of functional groups. Cross-linked styrene-polyvinyl copolymers are a notable example. Other monoethylenically unsaturated monomers, for example, alpha-methylstyrene, mono- and polychlorostyrenes, vinyltoluene, vinylanisole, vinylnaphthalene, and the like, have been disclosed as being copolymerizable with other polyvinylidiene monomers, for example, trivinylbenzene, divinylnaphthalene, divinylethene, trivinylpropene, and the like, to form desirable cross-linked copolymer matrices. Amberlyst A-21, described as a weakly basic anion exchange resin comprising a cross-linked styrene-divinylbenzene copolymer matrix having tertiary amine functional groups is a preferred anion exchange resin. Anion exchange resins manufactured under the tradename Amberlyst A-29 and Duolite A-7 are exemplary of a commercial anion exchange resin which can be employed. The former is described as an intermediate strength anion exchange resin and the latter is described as a weakly basic anion exchange resin comprising secondary and tertiary amine functional groups.

The metal chelate mercaptan oxidation catalyst employed as a component of the catalytic composite of this invention can be any of the various metal chelates known to the treating art as effective to catalyze the oxidation of mercaptans contained in a sour petroleum distillate with the formation of polysulfide oxidation products. Said chelates include the metal compounds of tetrapyridinoporphyrazine described in U.S. Pat. No. 3,980,582, e.g., cobalt tetrapyridinoporphyrazine; porphyrin and metalloporphyrin catalysts as described in U.S. Pat. No. 2,966,453, e.g., cobalt tetraphenylporphyrinsulfonate; corrinoid catalysts as described in U.S. Pat. No. 3,252,892, e.g., cobalt corrin sulfonate; chelate organometallic catalysts such as described in U.S. Pat. No. 2,918,426, e.g., the condensation product of an aminophenol and a metal of Group VIII, and the like. Metal phthalocyanines are a preferred class of metal chelate mercaptan oxidation catalysts.

The metal phthalocyanines employed as mercaptan oxidation catalysts generally include magnesium phthalocyanine, titanium phthalocyanine, hafnium phthalocyanine, vanadium phthalocyanine, tantalum phthalocyanine, molybdenum phthalocyanine, manganese phthalocyanine, iron phthalocyanine, cobalt phthalocyanine, nickel phthalocyanine, platinum phthalocyanine, palladium phthalocyanine, copper phthalocyanine, silver phthalocyanine, zinc phthalocyanine, tin phthalocyanine and the like. Cobalt phthalocyanine and vanadium phthalocyanine are particularly preferred. The metal phthalocyanine is most frequently employed as a derivative thereof, the commercially available sulfonated derivatives, e.g., cobalt phthalocyanine monosulfonate, cobalt phthalocyanine disulfonate or a mixture thereof, being particularly preferred. The sulfonated derivatives may be prepared, for example, by reacting cobalt, vanadium or other metal phthalocyanine with fuming sulfuric acid. While the sulfonated derivatives are preferred, it is understood that other derivatives, particularly the carboxylated derivatives may be employed. The carboxylated derivatives are readily prepared by the action of trichloroacidic acid on the metal phthalocyanine.

The metal chelate mercaptan oxidation catalyst is readily adsorbed on the basic anion exchange resin of this invention. In general, up to about 25 wt. % metal phthalocyanine can be adsorbed on the anion exchange resin and still form a stable catalytic composite. A lesser amount in the range of from 0.1 to about 10 wt. % generally forms a suitably active catalytic composite although the activity advantage derived from concentrations in excess of about 2 wt. % has not heretofore warranted the use of higher concentrations.

The selected metal chelate mercaptan oxidation catalyst can be impregnated on the anion exchange resin in any conventional or otherwise convenient manner from an aqueous or alcoholic solution and/or dispersion thereof. The anion exchange resin is advantageously washed with alcohol prior to impregnation with the selected metal chelate mercaptan oxidation catalyst. The alcohol wash has proven to be a key factor in the manufacture of a catalytic composite suitably active with respect to the conversion of mercaptans contained in a sour petroleum distillate. Methyl alcohol is a preferred washing agent, largely because it is readily available and relatively inexpensive. Impregnation is otherwise suitably effected utilizing conventional techniques whereby the anion exchange resin is soaked, suspended, dipped one or more times, or otherwise immersed in an aqueous or alcoholic impregnating solution and/or dispersion to adsorb a given quantity of the metal chelate component thereon. One preferred method involves the use of a steam-jacketed rotary dryer. The anion exchange resin is immersed in the impregnating solution and/or dispersion contained in the dryer and the resin is tumbled therein by the rotating motion of the dryer. Evaporation of the solution in contact with the tumbling anion exchange resin is expedited by applying steam to the dryer jacket. In any case, the resulting composite is allowed to dry under ambient temperature conditions, or in flow of hot gases, or in any other suitable manner.

An alternative and convenient method for adsorbing the metal chelate on the anion exchange resin comprises predisposing the anion exchange resin in a sour petroleum distillate treating zone or chamber as a fixed bed and passing the metal chelate impregnating solution and/or dispersion through the bed in order to form the catalytic composite in situ. This method allows the solution and/or dispersion to be recycled one or more times to achieve a desired concentration of the metal chelate component on the anion exchange resin. In still another alternative method, the anion exchange resin may be predisposed in said treating zone or chamber, and the zone or chamber thereafter is filled with the impregnating solution and/or dispersion to soak the resin for a predetermined period.

In the process of sweetening a sour petroleum distillate, it has heretofore been the practice to oxidize the mercaptans contained therein in the presence of an alkaline reagent. The alkaline reagent, usually an aqueous caustic solution, is passed in contact with the catalytic composite, continuously or intermittently as required, admixed with the sour petroleum distillate. However, it is a feature of the catalytic composite of this invention that the added alkaline reagent is not essential, and the addition and subsequent separation of the alkaline reagent can be eliminated to further simplify the sweetening process.

The conversion of mercaptans contained in a sour petroleum distillate can be effected in accordance with the method of this invention at ambient temperature conditions although temperatures up to about 105° C., and commensurate with the thermal stability of the anion exchange resin, are suitably employed. Pressures ranging up to about 1000 psi or more are operable, although atmospheric pressure, or substantially atmospheric pressure, is entirely suitable. Contact times equivalent to a liquid hourly space velocity of from about 0.5 to about 10 or more are effective to achieve a desired reduction in the mercaptan content of a sour petroleum distillate, an optimum contact time being dependent on the size of the treating zone, the quantity of catalyst contained therein, and the character of the distillate being treated.

As previously stated, the sour petroleum distillate is treated in contact with an oxidizing agent. The oxidizing agent is preferably air, although oxygen or other oxygen-containing gases may be employed. The sour distillate may contain sufficient entrained air, but generally air is admixed with the distillate to provide from about 1.5 to about 2 times the stoichiometric amount required to oxidize and convert the mercaptan content thereof to innocuous disulfides.

The method of this invention is preferably effected in a continuous type of operation whereby a substantially water-free sour distillate, in admixture with air, is processed upwardly or downwardly through a fixed bed of catalyst disposed in a vertical treating column. However, the fluid character of the catalytic composite of this invention also lends itself advantageously to a moving bed or slurry type of operation.

The following Examples are presented in illustration of certain preferred embodiments of this invention and are not intended as an undue limitation on the generally broad scope of the invention as set out in the appended claims.

EXAMPLE I

In the preparation of an anion exchange resin-supported mercaptan oxidation catalyst, 100 cc of a weak base anion exchange resin (Amberlyst A-21) containing tertiary amine functional groups was impregnated with an aqueous caustic solution of cobalt phthalocyanine monosulfonate, the anion exchange resin having been previously washed with methanol. The aqueous caustic impregnating solution consisted of 150 mg of cobalt phthalocyanine monosulfonate dissolved in a 7 wt. % aqueous caustic solution. The anion exchange resin, in the form of 0.4–0.55 mm beads, was immersed in the impregnating solution, and the solution was stirred in contact with the anion exchange resin for about 5 minutes. The resin was thereafter maintained in the solution under quiescent conditions for about 1 hour after which the solution was evaporated to dryness in contact with the resin over a steam bath. The impregnated resin was subsequently oven-dried at about 100° C. for 1 hour.

The catalyst of this example is hereinafter referred to as Catalyst A.

EXAMPLE II

Catalyst B was prepared substantially as described except that the anion exchange resin employed was a strong base anion exchange resin (Amberlyst A-26) containing quaternary ammonium hydroxide functional groups.

The above described catalysts were each evaluated with respect to a raw debutanized FCC gasoline boiling in the 112°–448° F. range and containing 58 ppm. mercaptan sulfur. In each case, 13.3 cc of the catalyst and 100 cc of gasoline were contained in a closed glass vessel with air at ambient conditions of temperature and pressure, and the glass vessel was inserted in a mechanical shaking device. The gasoline was shaken in contact with the catalyst and analyzed for residual mercaptan sulfur and gum after 5, 15 and 30 minute intervals. The results are tabulated on the following page.

| | Mercaptan Sulfur, ppm. Catalyst | | Gum,mg/100 cc Catalyst | |
|---|---|---|---|---|
| Time, min. | A | B | A | B |
| 0 | 58 | 58 | 1.5 | 1.5 |
| 5 | 1 | 5 | Not Analyzed | |
| 15 | 1 | 4 | 1.5 | 0.7 |
| 30 | 1 | 2 | 0.6 | 0.2 |

I claim as my invention:

1. A method of treating a sour petroleum distillate for the conversion of mercaptans contained therein which comprises contacting said distillate with an oxidizing agent and a catalytic composite consisting essentially of a metal chelate mercaptan oxidation catalyst impregnated on a basic anion exchange resin.

2. The method of claim 1 further characterized in that said anion exchange resin is an amine anion exchange resin.

3. The method of claim 1 further characterized in that said anion exchange resin is an amine anion exchange resin comprising a porous styrene-divinylbenzene cross-linked polymer matrix.

4. The method of claim 1 further characterized in that said anion exchange resin is an amine anion exchange resin comprising a porous styrene-divinylbenzene cross-linked polymer matrix and primary amine functional groups.

5. The method of claim 1 further characterized in that said anion exchange resin is an amine anion exchange resin comprising a porous-divinylbenzene cross-linked polymer matrix and secondary amine functional groups.

6. The method of claim 1 further characterized in that said anion exchange resin is an amine anion exchange resin comprising a porous styrene-divinylbenzene cross-linked polymer matrix and tertiary amine functional groups.

7. The method of claim 1 further characterized in that said anion exchange resin is an amine anion exchange resin comprising a porous styrene-divinylbenzene cross-linked polymer matrix and quaternary amine functional groups.

8. The method of claim 1 further characterized in that said metal chelate mercaptan oxidation catalyst comprises from about 0.1 to about 10 wt. % of said catalytic composite.

9. The method of claim 1 further characterized in that said metal chelate mercaptan oxidation catalyst comprises from about 0.1 to about 2 wt. % of said catalytic composite.

10. The method of claim 1 further characterized in that said metal chelate mercaptan oxidation catalyst is a metal phthalocyanine.

11. The method of claim 1 further characterized in that said metal chelate mercaptan oxidation catalyst is cobalt phthalocyanine.

12. The method of claim 1 further characterized in that said metal chelate mercaptan oxidation catalyst is cobalt phthalocyanine monosulfonate.

* * * * *